US006149352A

United States Patent [19]

MacDonald

[11] Patent Number: 6,149,352

[45] Date of Patent: Nov. 21, 2000

[54] RETAINING WALL BLOCK SYSTEM

[75] Inventor: Robert A. MacDonald, Plymouth, Minn.

[73] Assignee: Keystone Retaining Wall Systems, Inc., Bloomington, Minn.

[21] Appl. No.: 09/248,435

[22] Filed: Feb. 11, 1999

[51] Int. Cl.[7] ..... E02D 3/02; E02D 17/20

[52] U.S. Cl. ..... 405/284; 405/286; 52/606; 52/608; 52/747.12

[58] Field of Search ..... 405/284, 285, 405/286; 52/596, 603, 604, 606, 608, 609, 610, 612, 747.12

[56] References Cited

U.S. PATENT DOCUMENTS

| | | | |
|---|---|---|---|
| Re. 34,314 | 7/1993 | Forsberg . | |
| 4,738,059 | 4/1988 | Dean, Jr. | 52/596 X |
| 4,914,876 | 4/1990 | Forsberg . | |
| 4,920,712 | 5/1990 | Dean, Jr. | 405/286 X |
| 5,078,940 | 1/1992 | Sayles . | |
| 5,161,918 | 11/1992 | Hodel | 405/286 |
| 5,217,630 | 6/1993 | Sayles . | |
| 5,294,216 | 3/1994 | Sievert . | |
| 5,511,902 | 4/1996 | Center | 405/286 X |
| 5,535,568 | 7/1996 | Quinn | 52/608 |
| 5,598,679 | 2/1997 | Orton et al. . | |
| 5,644,891 | 7/1997 | Kafarowski | 52/747.12 X |
| 5,711,130 | 1/1998 | Shatley . | |
| 5,735,643 | 4/1998 | Castonguay et al. . | |
| 5,848,511 | 12/1998 | Scales | 405/286 X |
| 6,024,517 | 2/2000 | Castonguay et al. | 405/286 |

*Primary Examiner*—Eileen D. Lillis
*Assistant Examiner*—Jong-Suk Lee
*Attorney, Agent, or Firm*—Popvich & Wiles, P.A.

[57] ABSTRACT

A retaining wall block includes blocks of different sizes that are configured to be compatible with each other in the construction of a retaining wall or free-standing wall. Each block has at least three faces which are textured to produce the appearance of natural stone. The faces have varying sizes based on variations in width.

7 Claims, 8 Drawing Sheets

RETAINING WALL BLOCK SYSTEM

FIELD OF THE INVENTION

This invention relates generally to retaining wall blocks and retaining walls constructed from such blocks. In particular, this invention relates to a retaining wall block system that allows the construction of walls having a random natural appearance with varying block face sizes to create the appearance of a natural stone wall.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

In recent years, segmental concrete retaining wall units, which are dry stacked (i.e., built without the use of mortar), have become widely accepted in the construction of retaining walls. An example of such a unit is described in U.S. Pat. No. Re 34,314, which issued to Forsberg (Forsberg '314). Such retaining wall units have gained popularity because they are mass produced and, consequently, relatively inexpensive. They are structurally sound, easy and relatively inexpensive to install, and couple the durability of concrete with the attractiveness of various architectural finishes. The retaining wall system described in Forsberg '314 has been particularly successful because of its use of a block design that includes, among other design elements, a unique pinning system that interlocks and aligns the retaining wall units, thereby providing structural strength and allowing efficient installation. This system is advantageous in the construction of larger walls, when combined with the use of geogrids hooked over the pins, as described in U.S. Pat. No. 4,914,876 to Forsberg ('876).

The shape of the block is also an important feature during installation of a retaining wall. Forsberg '876 illustrates a fairly complex shape for a retaining wall block which is particularly advantageous in the construction of curved walls. The block is symmetrical about a vertical plane which bisects the block at a midway point through the front and back faces.

Many commercially available blocks are symmetrical about a plane bisecting the front and back surfaces. Typically such blocks have planes rather than axes of symmetry, as there are differences between the top and bottom surfaces of such blocks. Clearly, blocks that are substantially square or rectangular (i.e., each surface being joined to another at an orthogonal angle) exhibit a great deal of symmetry. Other blocks are more complex in shape and exhibit only one vertical plane of symmetry. For example, U.S. Pat. No. 5,711,130 (Shatley) illustrates a block having substantially parallel front and back faces and non-parallel, mirror-image side wall surfaces. That is, there is a mirror plane of symmetry that vertically bisects the block. U.S. Pat. No. 5,294,216 (Sievert) illustrates a type of block having parallel front and back faces and non-parallel, converging side surfaces. The term "converging side surfaces" means that the sides walls of the blocks converge as they approach the rear of the block. Such blocks are also symmetrical about a vertical plane that passes through the front and back surfaces.

There are advantages to having non-parallel surfaces on these blocks when constructing a retaining wall. The angles formed by these side surfaces permits construction of curvilinear walls, and moreover, permit the amount of curvature to vary according to the terrain and desired appearance of the retaining wall.

Another important feature of retaining wall blocks is the appearance of the block. Blocks having angled or curved faces are well known in the art. Many manufacturers also vary the color and the texture or pattern on the front face of the block. It might be desirable for the face of the block to be smooth, serrated, or grooved or to have an aggregate appearance.

The look of weathered natural stone is very appealing for retaining walls. There are several methods in the art to produce concrete retaining wall blocks having an appearance that to varying degrees mimics the look of natural stone. One well known method is to split the block during the manufacturing process so that the front face of the block has a fractured concrete surface that looks like a natural split rock. This is done by forming a slab in a mold and providing one or more grooves in the slab to function as one or more splitting planes. The slab is then split apart to form two or more blocks.

Another method to create a weathered stone appearance is to tumble the blocks together with other blocks in a large rotating canister. The collisions of the blocks in the tumbler chips off random pieces of the blocks, rounding the edges and creating a look that can be quite close to the appearance of a natural stone. This is a labor intensive undertaking that also can result in undesirable damage to the blocks and high overall costs of production.

Another method to make naturally appearing blocks has been described in U.S. Pat. Nos. 5,078,940 and 5,217,630 (both to Sayles). These patents describe a method and an apparatus for manufacturing a concrete block having an irregular surface. The irregular surface can be made to look similar to split stone, and thus is very desirable. This is done by pouring uncured block material into a mold cavity and causing a portion of the material to be retained in place relative to the cavity walls when the block is removed from the cavity. This results in a split appearance for the surface, without having to perform the splitting operation. This is an advantage because the expense and time of conventional block splitting is avoided.

Typically, retaining wall blocks are manufactured to have the desired appearance on the front face (i.e., the outer face of a wall) only. In the patents described above, the pattern or design is typically provided only to the front face because that is the only portion of the retaining wall block that is visible after the wall is constructed. Sometimes a portion of a side surface may be provided with a desired pattern or texture. Further, sometimes two opposing surfaces of a cap block may be textured. In the Sayles patents described above, a natural or split look is obtained for only the front face. Such blocks do not allow the user the option to use either the front, side, or back faces of the block interchangeablity as the exposed "front face". To create a wall block that has a roughened texture on the front, side and back surfaces poses certain problems. If a splitting method is used, multiple splits and two orientations for the splits are required to create a quadrilateral block with texture on three sides. If a tumbling method is used, substantial portions of the block faces will be smooth and not entirely natural looking. Tumbling also is an expensive production method. If the method combines splitting and tumbling, the cost of production increases to a point where the end cost to the consumer is very high.

Creating a random, or ashlar, pattern in the face of a retaining wall is highly desirable. This gives the appearance of a mortared or dry-stacked natural stone wall, which is a traditional and well accepted look. Some current wall blocks are intended to create an ashlar pattern. However, the creation of a truly random appearance requires the production of multiple block shapes for use in a single retaining wall. This is inefficient from a production standpoint because this requires multiple molds and more kinds of blocks to inventory. If only one face of the block is intended to be the front face, then the block system will suffer a trade-off between having enough face sizes to create a random, natural appearance and the cost and inefficiency of using multiple molds and creating multiple inventory items.

Because of the natural variation in size of the stones used in stone retaining walls, the wall surface has variations in depth from stone to stone. None of the prior art concrete segmental retaining wall blocks is capable of duplicating this effect due to their alignment and connection systems requiring uniform alignment of the blocks and their front faces. It would be desirable to produce a block that could have random variations in face depth while maintaining the structural integrity of the wall structure.

It would be desirable to provide a system of blocks for constructing a retaining wall that combines the ease of installation of modern segmental retaining walls with the attractive appearance of a natural stone wall composed of stones of varying sizes. The block system should be efficient to produce, require a minimal number of different block shapes and allow the construction of walls with 90 degree corners, and the construction of freestanding walls with a desirable natural appearance. It would also be desirable to provide a retaining wall system that allowed an aesthetically pleasing randomness of appearance by varying the amount the front faces of individual blocks project out from the face of the wall, so that certain blocks project slightly out and others are slightly recessed, at the wall builder's option. Moreover, it would be desirable to provide a retaining wall block with a weathered appearance on at least three sides that could be manufactured in a manner that minimizes the need for splitting or tumbling the block.

SUMMARY OF THE INVENTION

This invention is a system of blocks comprising blocks of different sizes that are configured to be compatible with each other in the construction of a retaining wall or free-standing wall. Each block has at least three faces which are textured in a manner resulting in an appearance like that of natural stone. The faces have varying sizes based on variations in width. The orientation of the faces may be reversed so that either the front or the back of the block may serve as an exposed face, to give the wall a pleasing random variation of the block sizes that creates the look of a natural stone wall. In a preferred embodiment, the wall blocks use an attachment system that allows a positive connection between courses of blocks, and which accommodates reversal in orientation of the blocks if desired. The attachment system also allows the individual blocks to be aligned with varying degrees of outward projection, to give the wall builder another means of introducing randomness to the appearance of the wall face. The blocks can be used to construct retaining walls, free-standing walls, or sharp corners (i.e., 90 degree angles) with a natural finish on all exposed sides. The block's side surfaces are configured to accommodate the construction of a variety of retaining walls, including walls having convex or concave curves. Known soil reinforcement methods such as geogrids may readily accommodated by the wall system. The wall system is designed to be easy to install and structurally sound.

In one aspect, this invention is a wall block for use in forming a wall from multiple wall blocks, the wall having a front surface and a rear surface, the block comprising an upper surface spaced apart from a substantially parallel lower surface, thereby defining a block thickness; opposed and substantially parallel first and second faces, the first face having an area greater than the second face; opposed and non-parallel side surfaces, the first and second faces being orthogonal to one of the side surfaces, the first and second faces together with the upper, lower and side surfaces forming a block body; wherein the block body is configured such that when a wall is constructed from the blocks, the front surface of the wall is formed of the first faces of a portion of the multiple wall blocks and the second faces of others of the multiple wall blocks.

Preferably, the first face, the second face, and at least one side surface are textured in a manner resulting in the appearance of natural stone. The upper surface of the block may have first, second, and third pin-receiving apertures aligned along first, second, and third axes which are substantially perpendicular to the upper and lower surfaces, the third pin-receiving aperture being substantially equidistant between the first and second faces, the first pin-receiving aperture being between the first face and the third pin-receiving aperture and the second pin-receiving aperture being between the second face and the third pin-receiving aperture, the first, second, and third pin-receiving apertures being arranged in a row perpendicular to the first and second faces. Preferably, the first and second pin-receiving apertures are equidistant from the third pin-receiving aperture. The lower surface of the block may comprise a channel that is parallel to and equidistant from the first and second faces and the block may comprise a core extending the thickness of the block.

In a second aspect, this invention is a wall block system having at least three blocks, multiples of the three blocks being suitable for use in constructing a wall from multiple courses of the blocks stacked one upon the other, the wall having a front surface with an irregular block pattern, the wall block system comprising first, second, and third blocks, each block having a thickness, width and length, the width of each block being different; each block having an upper surface spaced apart from a substantially parallel lower surface, thereby defining the block thickness; each block having opposed and substantially parallel first and second faces, thereby defining the block length, the area of the first face being greater than the area of the second face; each block having opposed and non-parallel side surfaces, thereby defining the block width; the first, second, and third blocks being configured such that they are capable of being positioned when constructing the wall such that the front surface of the wall is comprised of the first faces of a plurality of the first, second, and third blocks and the second faces of a plurality of the first, second, and third blocks to thereby provide a front wall surface having an irregular block pattern.

Preferably, the upper surface of each of the three blocks has first, second, and third pin receiving apertures aligned along first, second, and third axes which are substantially perpendicular to the upper and lower surfaces, the third pin receiving aperture being substantially equidistant between the first and second faces, the first pin receiving aperture being between the first face and the third pin receiving aperture and the second pin receiving aperture being between the second face and the third pin receiving aperture, the first, second, and third pin receiving apertures being arranged in a row perpendicular to the first and second faces.

The wall block system also may comprise a plurality of pins, each pin having a head portion and a body portion, the pins being configured such that when a wall is constructed from the wall block system, the head portion is configured to be received within the channel of the lower surface of a block in a first course of the wall and the body portion is configured to be received in a pin-receiving aperture of a second block in a next lower course of the wall. If no setback between the courses is desired, the body portion of the pin is configured to be received in the third pin-receiving aperture. If setback between courses of the wall is desired, the body portion of the pin is configured to be received in the second pin receiving aperture of the second block if the second block is positioned such that its first face is part of the front surface of the wall and in the first pin receiving aperture of the second block if the second block is positioned such that its second face is part of the front surface of the wall. Preferably, the first and second pin-receiving apertures are equidistant from the third pin-receiving aperture.

In a third aspect, this invention is a wall having a front surface and a rear surface, the wall comprising: at least a first lower course and a second upper course, each course comprising a plurality of blocks; each block having an upper surface spaced apart from a substantially parallel lower surface, thereby defining a block thickness; each block having opposed and substantially parallel first and second faces, the first face having an area greater than the second face; each block having opposed and non-parallel side surfaces, the first and second faces being orthogonal to one of the side surfaces, the first and second faces together with the upper, lower and side surfaces forming a block body; the blocks being positioned in the courses such that the front surface of the wall comprises the first faces of a plurality of the blocks and the second faces of a plurality of the blocks to thereby provide an irregular block pattern. Preferably, the blocks in each course comprise first, second, and third blocks, the widths of the first, second, and third blocks being different, the blocks being positioned in the courses such that the front surface of the wall is comprised of the first faces of a plurality of the first, second and third blocks and the second faces of a plurality of the first, second, and third blocks.

In a fourth aspect, this invention is a wall having a front surface and a rear surface, the wall comprising: at least a first lower course and a second upper course, each course comprising a plurality of first, second, and third blocks; each block having an upper surface spaced apart from a substantially parallel lower surface, thereby defining a block thickness; each block having opposed and substantially parallel first and second faces, thereby defining a block length, the area of the first face being greater than the area of the second face; each block having opposed and non-parallel side surfaces, thereby defining a block width, the width of the first, second, and third blocks being different; the blocks being positioned in the courses such that the front surface of the wall is comprised of the first faces of a plurality of the first, second, and third blocks and a plurality of the second faces of the first, second, and third blocks to thereby provide an irregular block pattern. The wall may further comprise a plurality of pins, each pin having a head portion and a body portion, the head portion being configured to be received within the channel of the lower surface of a block in a first course of the wall and the body portion being configured to be received in a pin receiving aperture of a second block in a next lower course of the wall. When the front surface of the wall is substantially vertical, the body portion of the pin is configured to be received in the third pin receiving aperture.

In a fifth aspect, this invention is a wall block for use in forming a wall from multiple wall blocks, the wall having a front surface and a rear surface, the block comprising: an upper surface spaced apart from a substantially parallel lower surface, thereby defining a block thickness, the upper surface having first, second, and third pin receiving apertures aligned along first, second, and third axes which are substantially perpendicular to the upper and lower surfaces, the third pin receiving aperture being substantially equidistant between the first and second faces, the first pin receiving aperture being between the first face and the third pin receiving aperture and the second pin receiving aperture being between the second face and the third pin receiving aperture, the first, second, and third pin receiving apertures being arranged in a row perpendicular to the first and second faces; opposed and substantially parallel first and second faces; opposed and non-parallel side surfaces, the first and second faces together with the upper, lower and side surfaces forming a block body; and wherein the block body is configured such that when a wall is formed from the wall block, the front surface of the wall is formed of the first faces of a portion of the multiple wall blocks and the second faces of others of the multiple wall blocks.

In a sixth aspect, this invention is a method for constructing a wall from blocks laid in multiple courses, one upon the other, such that the wall has a front surface with an irregular block pattern, the method comprising: providing wall blocks described above, and laying the blocks in a first course of the wall and a second course of the wall such that the front surface of the wall is formed of the first faces of a plurality of the blocks and the second faces of a plurality of the blocks. Preferably the method includes providing blocks having an attachment system allowing blocks in one course to be attached to blocks in the next lower course. Substantially vertical walls or angled walls may be obtained.

In a seventh aspect, this invention is a method for constructing a wall from blocks laid in multiple courses, one upon the other, such that the wall has a front surface with an irregular block pattern, the method comprising: providing a wall block system which includes blocks as described above of at least three sizes including first, second, and third blocks, each block having a thickness, width and length, the width of each block being different; laying the first, second, and third blocks in the first and second courses such that the front surface of the wall is comprised of the first faces of a plurality of the first, second, and third blocks and the second faces of a plurality of the first, second, and third blocks to thereby provide a front wall surface having an irregular block pattern.

DETAILED DESCRIPTION OF THE PREFERRED EMBODIMENTS

In this application, "upper" and "lower" refer to the placement of the block in a retaining wall. The lower, or bottom, surface is placed such that it faces the ground. In a retaining wall, one row of blocks is laid down, forming a course. An upper course is formed on top of this lower course by positioning the lower surface of one block on the upper surface of another block.

This invention is a block system comprising multiple sizes of blocks with differently dimensioned, interchangeable front and back faces. The blocks can be used to construct an eye pleasing, irregularly textured wall having a weathered, natural appearance. The texture of the wall is due to the variation in the size of the blocks, the weathered, natural appearance on the surfaces of the individual blocks, and the placement of the blocks in the wall. The shape of the blocks permits construction of stable walls having curved, or serpentine, shapes.

The blocks are provided with pin-receiving apertures and channels, which, along with pins that are adapted to be received in the pin-receiving apertures, form an attachment system among the blocks in a wall. Any number of apertures could be used, but preferably, there are at least three pin-receiving apertures. Preferably, these apertures are in a line perpendicular to the first and second faces of the block at a midpoint between the first and second faces. Typically, the pin-receiving apertures are equidistant from each other.

For blocks having core 20, as shown in FIG. 1, preferably there are two sets of three apertures disposed on either side of the core (i.e., one set is 22*a*, 22*b* and 22*c* and the second set is 22*d*, 22*e*, and 22*f*). For smaller blocks which typically do not have a core, only one set of apertures is necessary. The apertures are positioned to permit the alignment of blocks directly over one another or either forward or backward relative to one another so that either vertical or non-vertical walls may be constructed. Having more than one set of apertures allows a block in an upper course to span two blocks in a lower course and be locked into place in both of them. Preferably, a pin comprises a shoulder or head portion affixed to a body portion. The lower surface of the blocks comprises a channel that has a shape and a depth configured to receive the head portion of a pin when the pin is held in the aperture of an underlying block.

Figure 1A:
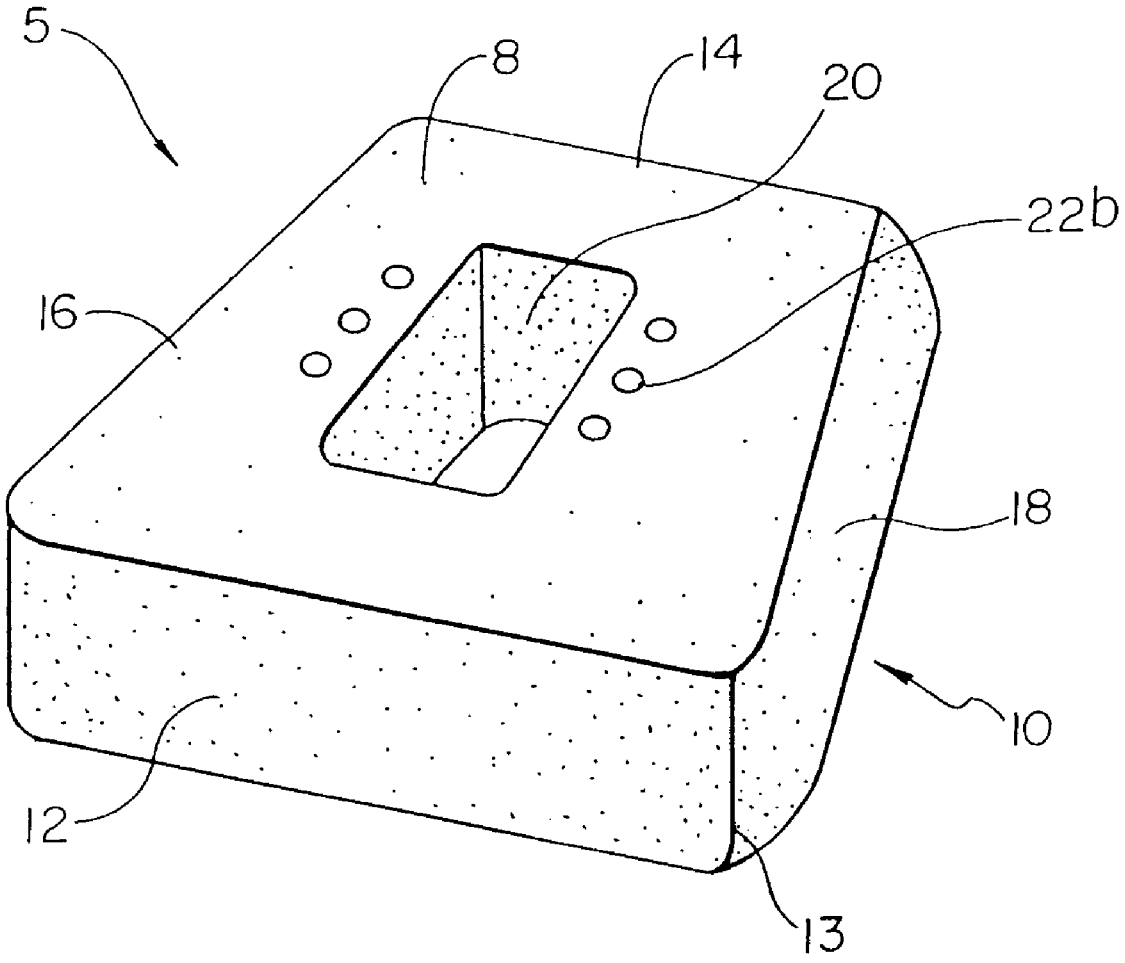
FIGS. 1A, 1B, and 1C illustrate a perspective view, a top view, and a bottom view of a retaining wall block according to this invention.
Figure 1B:
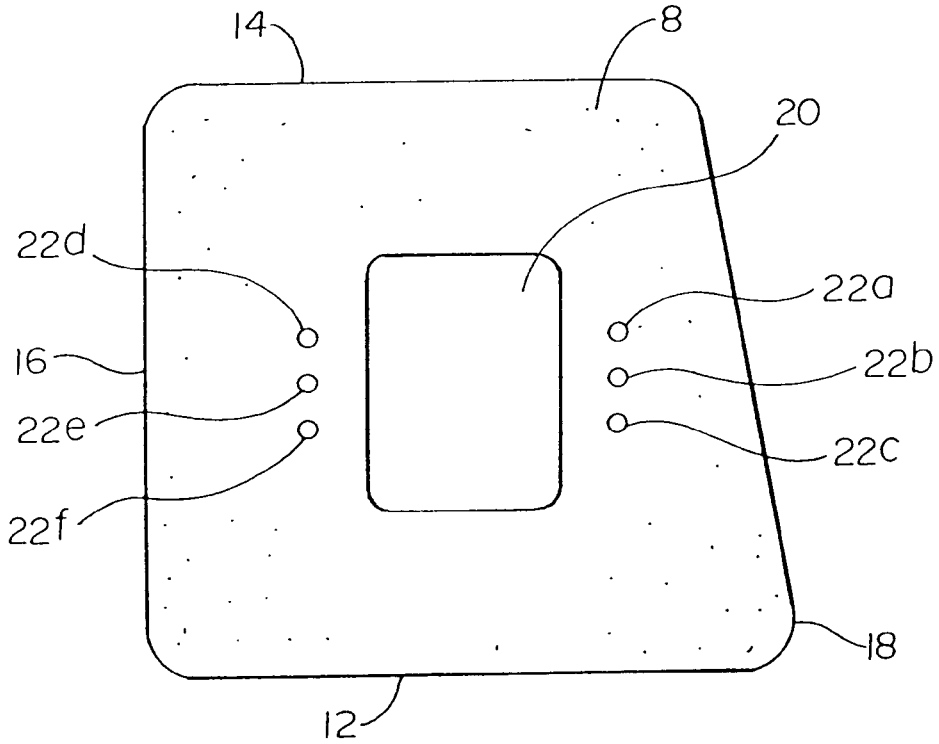
Figure 1C:
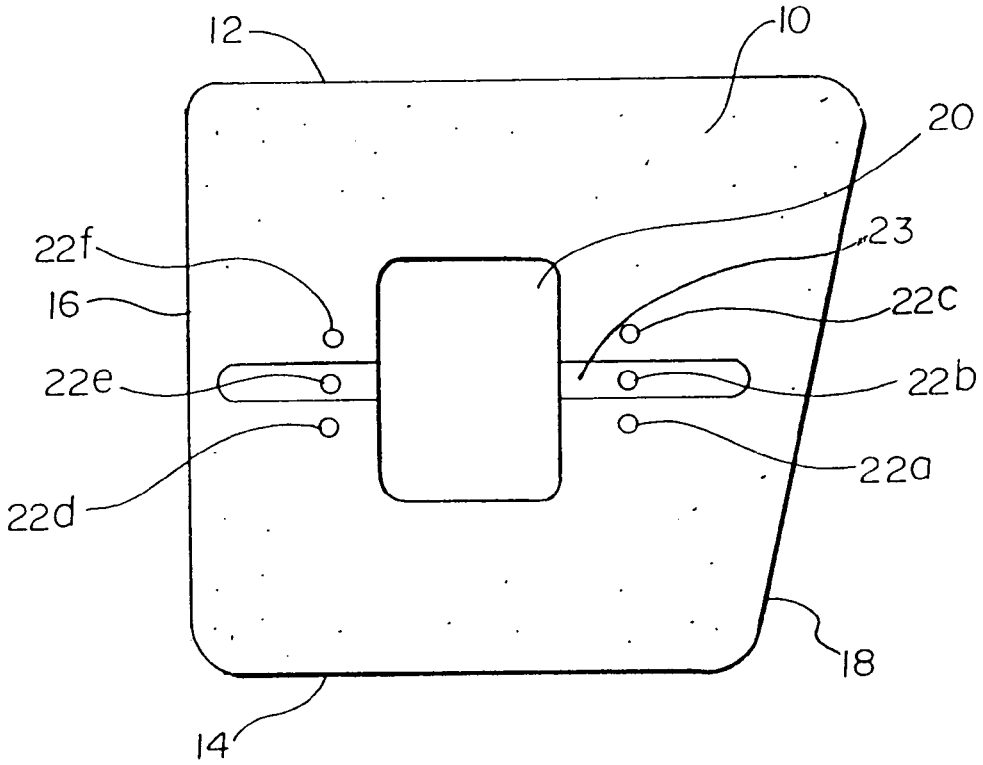

FIGS. 1A, 1B, and 1C illustrate a block of this invention. A perspective view of block 5 is shown in FIG. 1A and top and bottom views of block 5 are shown in FIGS. 1B and 1C, respectively. Upper surface 8 is opposed to and substantially parallel to lower surface 10. Surface 8 is separated from surface 10 by the thickness of the block. First and second opposed faces 12 and 14 are substantially parallel. First face 12 has a greater surface area than second face 14. First face 12 and second face 14 are joined by and orthogonal to first side surface 16. That is, the angle formed by an imaginary line coincident with first face 12 and an imaginary line coincident with first side surface 16 is 90 degrees. First face 12 and second face 14 also are joined to second side surface 18. Side surfaces 16 and 18 are opposed and are non-parallel. Similarly, the angle formed between second face 14 and first side surface 16 is 90 degrees. The angles formed between either of the first and second faces and side surface 18 are non-orthogonal. That is, one angle will be acute and one will be obtuse. The block is provided with through-passage or core 20, as well as with pin-receiving apertures 22*a*, 22*b*, and 22*c*. The lower surface of the block is provided with channel 23 that is in a line coincident with the center aperture (22*b*) of the three pin-receiving apertures and parallel to first and second faces 12 and 14 of the block. Channel 23 has a depth and a profile sufficient to permit the use of pins having a shoulder or lip to be used in the pin-receiving apertures. Channel 23 spans at least a portion of the width of the block.

The surfaces meet to form corners. For example, first face 12 meets side surface 18 to form corner 13. Because it is desirable to provide a natural stone-like appearance to the blocks, it is preferred that corners are rounded. The rounded corners give the blocks a "tumbled" appearance without the necessity of tumbling or processing the blocks after they are formed.

FIG. 1A shows a block having first face 12 which is textured in a manner resulting in the appearance of natural stone. Second face 14 and side face 16 are similar in appearance, that is, they have a natural stone-like weathered appearance. Side surface 18, which sometimes is referred to as the angled side, is smoother than the other faces. It is conventional in the art of retaining wall blocks to refer to one face as the front face, that is, that facing outward in a retaining wall. As described above, conventional retaining wall blocks typically are designed to have a front face which is distinct in appearance from the back face. However, first and second faces 12 and 14 are interchangeable as they have the same weathered, natural appearance; that is, these faces may be either the front or the back of the block. One of the faces must have a larger surface area than the other of the faces. In addition, side face 16 has the same weathered appearance or texture as first and second faces 12 and 16. Thus, depending upon the dimensions of the block, the block may be rotated such that any of faces 12, 14, and 16 can be the "front" of the block. This can be seen in FIG. 2, wherein the top corner of the wall is a block with both a first face and a side surface facing outward.

Figure 7:
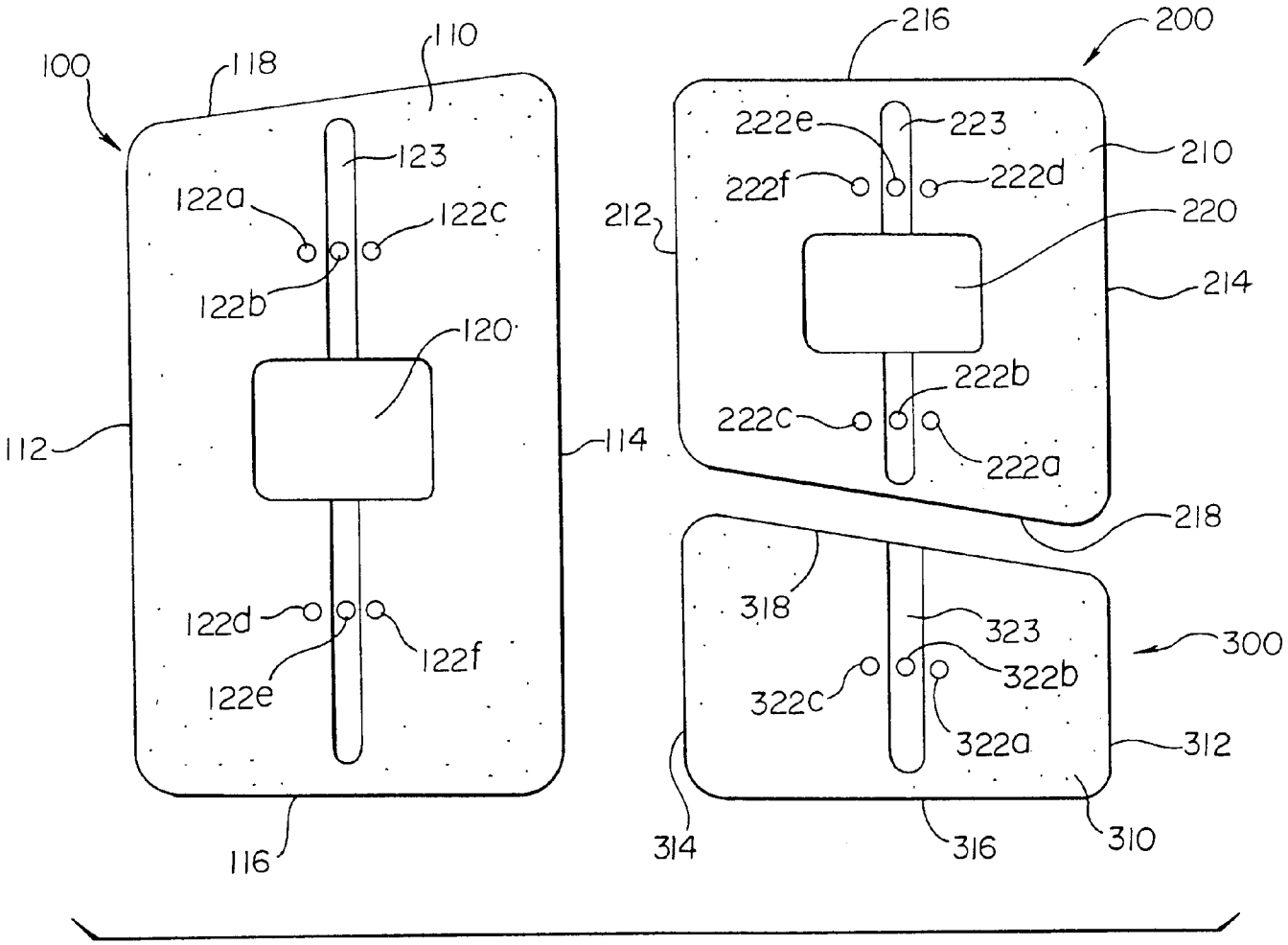
FIG. 7 is a bottom view of the block system of this invention.

The block is manufactured to a desired thickness. This may range from about three inches (7.6 cm) to about 6 inches (15.2 cm) though it may be thinner or thicker depending upon the desired application. The block's dimensions are selected not only to produce a pleasing shape for the retaining wall, but also to permit ease of handling and installation. Typically one thickness of block is used to construct a retaining wall. The length of the block (i.e., defined as the distance from the first face to the second face) typically ranges from about 9.25 inches to about 10.25 inches. The width of the block (i.e., defined as the distance from one side surface to the other side surface, as measured at a midpoint) for a conventional retaining wall typically varies from about 4 to about 16 inches, as measured at a midpoint of the sides. For optimum use in retaining walls, the blocks of this invention are manufactured to have approximately the same length and various widths. Different sizes of blocks are illustrated in FIG. 7 and discussed further below.

The sides of the blocks may be tapered. That is, for example, the surface area of the bottom of the block may be larger than the surface area of the top of the block. Tapering is typically a result of the manufacturing processes when removing a block from its mold.

Figure 3B:
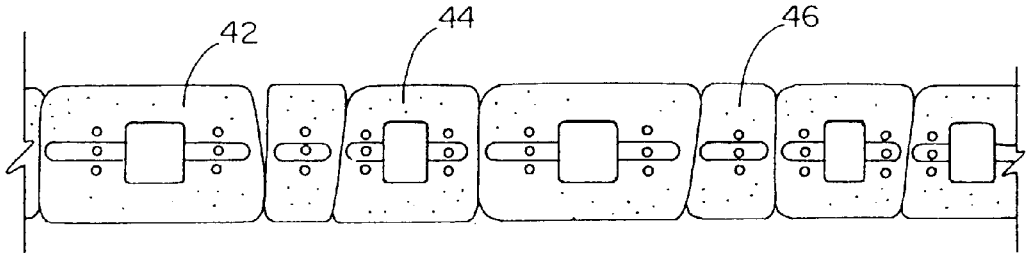
FIG. 3A is a front view of a retaining wall and FIG. 3B is a bottom view of the top-most course of blocks used in the retaining wall of FIG. 3A.

Blocks may provided with core, or passageway, 20, as shown in FIGS. 1A and 1B, preferably located generally at the center of the block. The core extends through the thickness of the block. The dimension of the core can be varied as desired. For example, in a block having a length from first to second faces of about 9.5 inches, the core is 3 to 4 inches long. Providing a core is preferred because it results in a reduced weight for the block and also permits easier handing during installation of a retaining wall. The core is also useful when forming parapet walls, because concrete grout can be used to fill the cores and strengthen the wall. Blocks having cores can be aligned so that a wall can be reinforced with tension rods. Railing posts can be used as anchors in the cores. FIG. 3B is a bottom view of a course of a wall comprising blocks having the same lengths but different widths.

The block preferably is provided with pin-receiving apertures. These apertures (22*a*, 22*b*, 22*c*; and 22*d*, 22*e*, 22*f*, as shown in FIGS. 1A and 1B) are provided as it is desirable to use pins to secure and align the blocks, attach a geogrid, and/or provide shear resistance.

The Figures illustrate blocks having one or two sets of three evenly spaced pin-receiving apertures that are arranged in a line perpendicular to the first and second faces. FIG. 1 shows that first pin-receiving apertures 22*c* and 22*f* are nearest first face 12, and the second (22*a* and 22*d*) is nearest second face 14. The third pin-receiving aperture (22*b* and 22*e*) lies between the first and second apertures, and preferably is spaced equidistant from them. The pin-receiving apertures are aligned along first, second, and third axes which are substantially perpendicular to the upper and lower surfaces. Of course, the number and the location of the pin-receiving apertures may be varied depending upon desired design features of a retaining wall. Typically, however, blocks having three pin-receiving apertures oriented as shown provide a maximum degree of flexibility in design choice. The function of these apertures is discussed further below.

Figure 2:
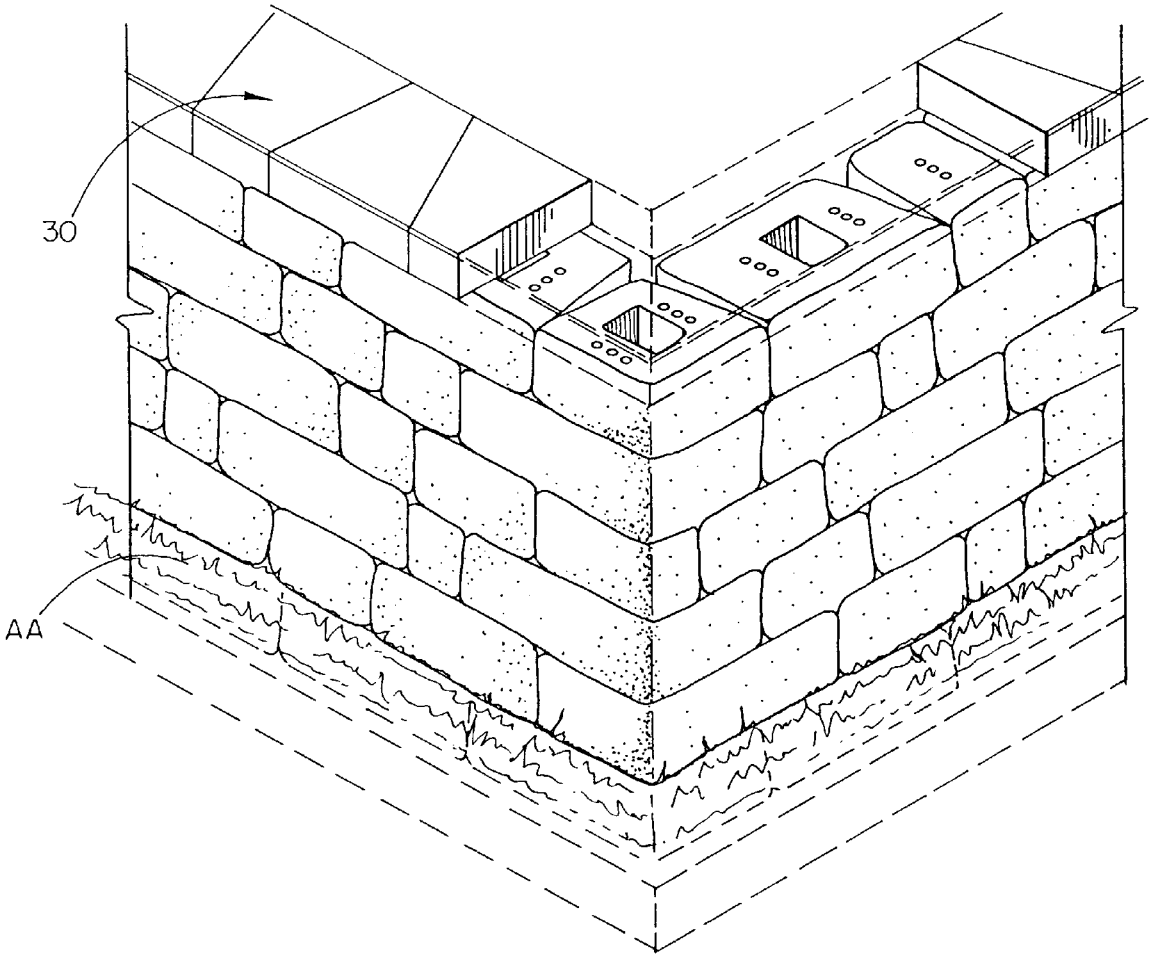
FIG. 2 is a perspective view of a retaining wall of this invention.

FIG. 2 illustrates a perspective view of a retaining wall made from the multiple block system of this invention. The first course of blocks AA of such a wall is typically laid in a trench and successive courses are laid one on top of the other. Pins can be used in the pin-receiving apertures to hold the courses of blocks in place, although in some applications where the wall design is simple, the weight of the blocks is sufficient to hold the blocks in place. In this illustration, three wall blocks, each having a different width, are used to form a wall having a front surface and a rear surface. Both the first and the second face of any one block may be used to form the front surface of the wall. The first and second faces of one block also are different in surface area. These features contribute to the random, natural appearance of the wall. An advantage of the block of this invention is that the as-manufactured block can be used in a wall having corners without any further surface treatment of the block. That is, both a front face and a side face are visible in this wall at the corner and both have a weathered, natural, appearance. Because the blocks of this invention have one angled side, the blocks may be used to form 90 degree corners. A random appearance of the wall is achievable since all sizes of blocks may be used anywhere in a wall. Alternatively, there may be an advantage in providing one of the blocks, preferably the smallest block, of this system with two sides that are angled. In this case, only the larger dimensioned blocks would be used to construct wall corners. A cap or finish layer 30 is shown in partial view at the top of the wall. The cap layer is discussed further below.

Figure 3A:
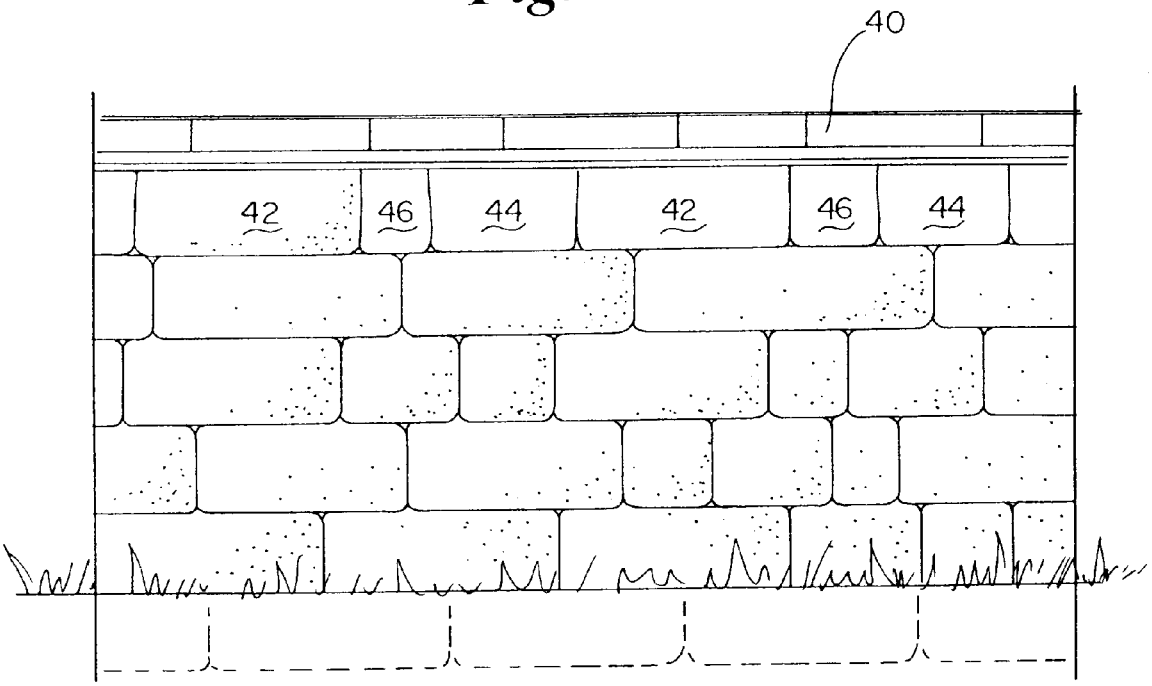

FIG. 3A illustrates random placement of differently sized wall blocks in a retaining wall. Blocks are first laid in a trench to form the base layer. Blocks having various widths are randomly placed. In addition, the first face and the second face are different in surface area, and either may face outward. This variability in size contributes to the random and natural appearance of the wall of the front surface of the wall. Cap layer 40 is shown spanning the top of the wall. FIG. 3B is a bottom view of the top-most course of blocks of the wall of FIG. 3A. FIG. 3B illustrates how the same block is used to vary the appearance of the front surface of the wall by using both the first and second block faces as the front surface of the wall. FIG. 3B also illustrates placement of retaining pins in the center aperture, thus aligning the blocks one above another. Blocks 42 and 44 use pins in apertures on either side of their cores. Block 42 spans two blocks in the course below. The head portion of the pins fits within the channel that runs parallel to the first and second faces of the block. In addition, blocks in the wall may be moved forward or rearward of the front surface of the wall by altering the position of a retaining pin (i.e., selecting the first or second pin-receiving aperture of an underlying block rather than the third, or middle, aperture).

Retaining pins 80 preferably are provided with a lip, shoulder, or head portion that prevents the pins from slipping through a pin-receiving aperture. When the pins are installed in the center pin-receiving aperture, the blocks of one course are aligned with blocks in adjacent courses, thus forming a straight wall. The head portion of the retaining pin fits within channel 23 of the block, thus holding the block in place. Having three pin-receiving apertures also permits construction of a wall in which some blocks may be placed slightly forward or behind adjacent blocks, which results in variable depth for the front face of the wall, thus producing a more natural stone-like appearance.

Figure 4:
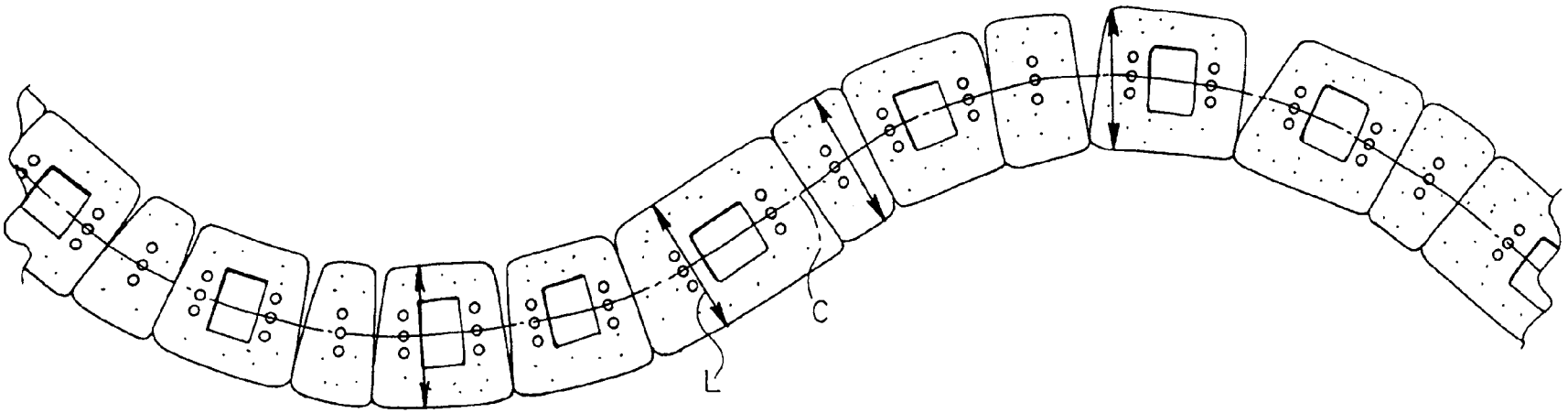
FIG. 4 is a top view of one course of a retaining wall of this invention.

FIG. 4 illustrates a top view of a course of blocks laid in a serpentine pattern. Continuous curved line C is shown running through the center of the blocks. Block length L is constant for the variously-sized blocks in this wall. Having one angled side surface per block permits a desirable degree of flexibility in the placement of the blocks, and is particularly noticeable on inside curves.

Figure 5A:
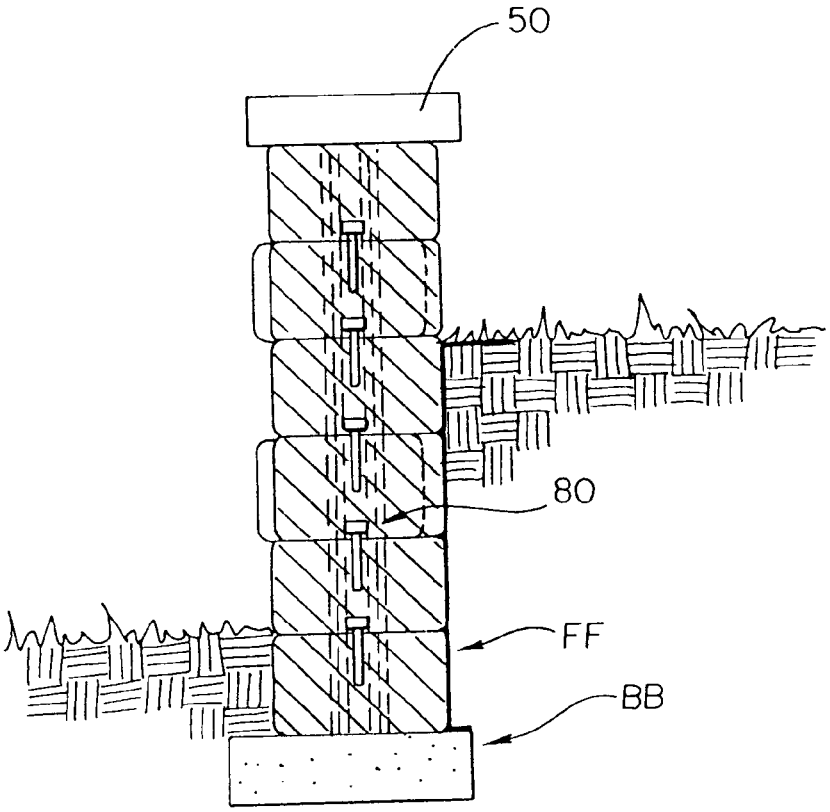
FIG. 5A is a side view of one embodiment of a retaining wall of this invention and FIG. 5B is a detailed cross-sectional view of retaining pin positioned between two blocks.

FIG. 5A is a side view of a retaining wall and illustrates placement of retaining pins 80 in the pin-receiving apertures of the block. A trench is dug and leveling pad BB is laid in the trench and the first course of blocks is laid on top of the leveling pad. Both of these layers are installed below grade. Leveling pad BB comprises compacted free draining granular road base material such as crushed stone or unreinforced concrete. The leveling pad creates a level and somewhat flexible wall support base and eliminates the need to trench to a depth that would resist frost. The leveling pad can move as the ground freezes if necessary. Before building the wall, filter fabric FF is installed against the soil. The filter fabric prevents the flow of fine silt or sand through the face of the wall. Thus water can flow through, but particles that can stain the wall cannot.

Figure 5B:
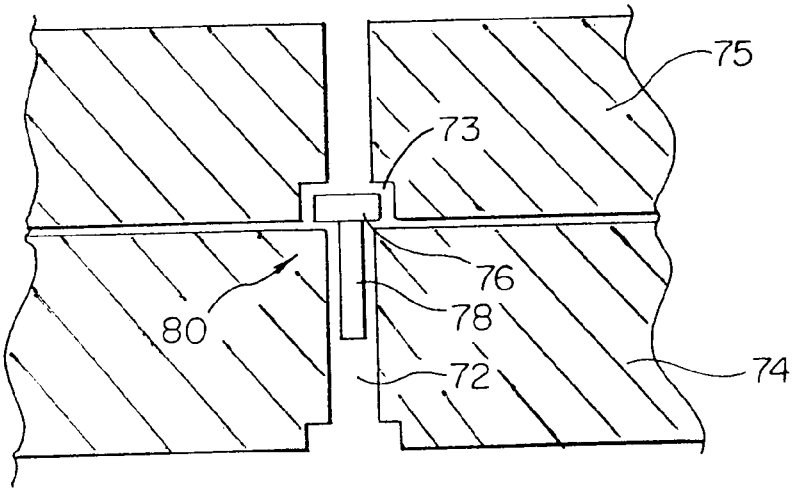

FIG. 5B illustrates a detailed cross-sectional view of a retaining pin positioned in a retaining wall. Blocks in the wall are provided with pin-receiving aperture 72 and with channel 73. In FIG. 5B, block 74 lies under block 75. Head portion 76 of pin 80 is configured to be received within channel 73 on the lower surface of block 75. Body portion 78 is configured to be received in pin-receiving aperture 72 of block 74. The shape of the channel in cross-section is configured to lock the head portion of pin 80 in place. Head portion 76 is larger in diameter than pin-receiving aperture 72 so that the pin does not fall through the aperture. The length of body portion 78 is less than the thickness of the block in this illustration although the length of the pin body may vary.

Cap, coping, or finish, layer 50 is installed at the top of the wall. The cap layer may comprise blocks, cut stone, or precast concrete pieces. Also, concrete can be cast in place for the finish layer. In any event, the cap layer may have the desired surface finish on its top and all sides or can vary as a matter of design choice. Its thickness and appearance are matters of design choice. Typically the cap layer has no apertures that pass through its thickness. This layer may be affixed to the underlying course by means of adhesive (i.e., mortar or epoxy), pins, or other suitable means known to those of skill in the art.

The wall shown in FIG. 5 is an example of a substantially vertical wall, a free-standing parapet wall, in which at least a portion of both the front and back faces of the wall is exposed. Thus, appearance of both wall faces is important. Because the block of this invention is manufactured to have the desired textured appearance of natural stone on three faces, the block can be installed to produce an attractive free-standing wall without any treatment or change to the surface of the block. Thus installation of a retaining wall even for a homeowner can be done easily and quickly without the need for special equipment.

Figure 6:
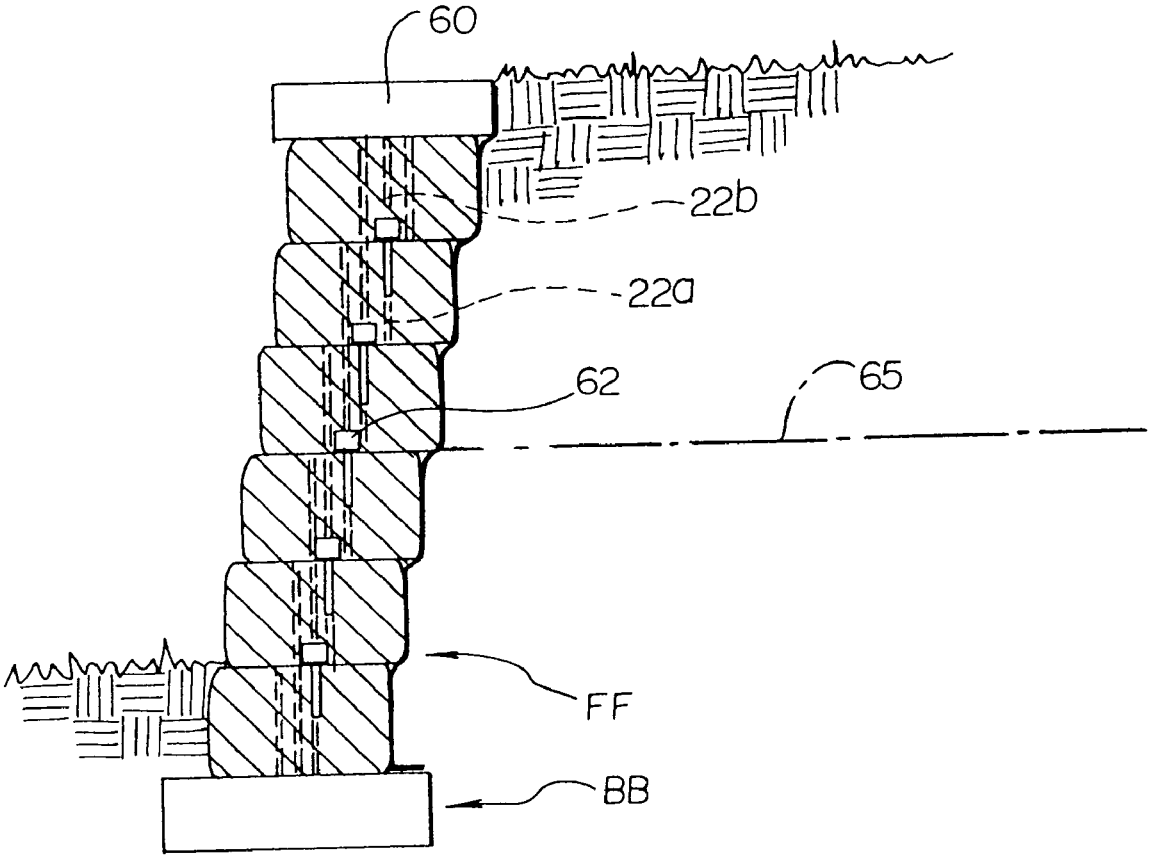
FIG. 6 is a side view of a second embodiment of a retaining wall of this invention.

FIG. 6 is a side view of another type of retaining wall, in which the blocks of an upper course are set back from the blocks of a lower course, resulting in a wall that is angled from vertical. Leveling pad BB and the first course of blocks are installed below grade. Filter fabric FF is placed against the soil and forms a backing against which other blocks are placed. The wall is finished, or capped, with cap layer 60. FIG. 6 illustrates a conventional retaining wall in which the retained soil is level with the top of the wall. The degree of set back for the wall is chosen based upon considerations of aesthetic appearance and necessary structural strength. The amount of set back illustrated in FIG. 6 for a conventionally constructed retaining wall wherein the block height is about six inches is about one inch. The amount of set back is determined by the location of the pin-receiving apertures in each block. Pins 62 fasten the blocks of an upper course to those of a lower course. FIG. 6 shows the body portion of pin 62 in the rear pin-receiving aperture (for example, 22*a*) of a block in a lower course and the head portion of that pin laying within the channel that is coincident with middle aperture (for example, 22*b*). Geogrid or geotextile 65 may be installed and held in place by both the blocks and the retaining pins to create a mechanically stabilized earth retaining wall. The use of geogrids is known in the art and is described, for example, in U.S. Pat. No. Re. 34,314 (Forsberg), hereby incorporated herein by reference.

FIG. 7 illustrates the block system of this invention. Each block is the same in length (i.e., distance from first to second face, for example, 112 to 114) but different in width (i.e. distance from first to second side, for example 116 to 118). Three sizes of blocks are shown. On the left side of FIG. 7, lower surface 110 of block 100 is illustrated. First and second opposing faces 112 and 114 are substantially parallel and face 114 has a larger surface area than face 112. Faces 112 and 114 are joined by and orthogonal to first side surface 116. Faces 112 and 114 are also joined to second side surface 118 at non-orthogonal angles. Core 120 is provided in block 100. Channel 123 and two sets of pin-receiving apertures (122*a*, 122*b*, 122*c*; and 122*d*, 122*e*, 122*f*) are on either side of core 120. Channel 123 is parallel to and at a midpoint between faces 112 and 114. The pin-receiving apertures are in a line perpendicular to faces 112 and 114, and apertures 122*b* and 122*e* are coincident with channel 123. Block 100 may have various dimensions, but preferably has the proportions as depicted in the Figure. A convenient and practical size is about 14.5 inches for the long dimension of first face 112 and about 15.75 inches for second face 114. The length of the block (from 112 to 114) is about 9.5 inches. The core is about 4 inches long and about 3 inches wide. The distance between the two sets of pin-receiving apertures is about 7.8 inches.

Lower face 210 of block 200 is at the top right side of FIG. 7. First and second opposing faces 212 and 214 are substantially parallel and face 214 has a larger surface area than face 212. Faces 212 and 214 are joined by and orthogonal to first side surface 216. Faces 212 and 214 are also joined to second side surface 218 at non-orthogonal angles. Core 220 is provided in block 200. Channel 223 and two sets of pin-receiving apertures (222*a*, 222*b*, 222*c*; and 222*d*, 222*e*, 222*f*) are provided in lower surface 210 of the block. The channel and the apertures are disposed on either side of the core. Channel 223 is substantially parallel to faces 212 and 214 and is coincident with apertures 222*b* and 222*e*. The length of this block is about 9.5 inches, and the long dimension of sides 212 and 214 is about 8.5 inches and 10 inches, respectively. The core is approximately 4 inches long and 2.75 inches wide.

Lower face 310 of block 300 is at the bottom right side of FIG. 7. First and second opposing faces 312 and 314 are substantially parallel and face 314 has a larger surface area than face 312. Faces 312 and 314 are joined by and orthogonal to first side surface 316. Faces 312 and 314 are also joined to second side surface 318 at non-orthogonal angles. Channel 323 and one set of pin-receiving apertures (322*a*, 322*b*, and 322*c*) is provided in lower surface 310 of the block. Channel 323 is substantially parallel to faces 312 and 314 and is coincident with aperture 322*b*. The length of this block is about 9.5 inches, and the long dimension of faces 312 and 314 is about 4.75 inches and 6 inches, respectively.

The blocks illustrated in FIG. 7 each have the same length but different widths. Further, each block has a first face that has a different surface area or, alternatively, a different long dimension (i.e., the distance between side surfaces as measured along the first face) than the second face. For construction of a wall and for optimum manufacturing processes, the length as well as the thickness of each block preferably are the same. The shape of the blocks therefore produces a high degree of flexibility in the placement of the blocks in a retaining wall, which is a cost advantage. Particularly desirable is a system in which all the blocks have the same length, but variable widths, so that a natural stone appearance is achieved for the wall. The pin-receiving apertures are used to form a wall with various degrees of set back, thus contributing to a natural appearance.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall having a front surface and a rear surface, the wall comprising:

at least a first lower course and a second upper course, each course comprising a plurality of blocks;

each block having an upper surface spaced apart from a substantially parallel lower surface, thereby defining a block thickness;

each block having opposed and substantially parallel first and second faces, the first face having an area greater than the second face;

each block having opposed and non-parallel side surfaces, the first and second faces being orthogonal to one of the side surfaces, the first and second faces together with the upper, lower and side surfaces forming a block body; and the blocks being positioned in the courses such that the front surface of the wall comprises the first faces of a plurality of the blocks and the second faces of a plurality of the blocks to thereby provide an irregular block pattern.

2. The wall of claim 1 wherein the blocks in each course comprise first, second, and third blocks, the widths of the first, second, and third blocks being different, the blocks being positioned in the courses such that the front surface of the wall is comprised of the first faces of a plurality of the first, second and third blocks and the second faces of a plurality of the first, second, and third blocks.

3. The wall of claim 1 wherein the first face, the second face, and at least one side surface are textured in a manner resulting in the appearance of natural stone.

4. The wall of claim 1 wherein the upper surface of each block has first, second, and third pin receiving apertures aligned along first, second, and third axes which are substantially perpendicular to the upper and lower surfaces, the third pin receiving aperture being substantially equidistant between the first and second faces, the first pin receiving aperture being between the first face and the third pin receiving aperture and the second pin receiving aperture being between the second face and the third pin receiving aperture, the first, second, and third pin receiving apertures being arranged in a row perpendicular to the first and second faces.

5. The wall of claim 4 wherein the first and second pin receiving apertures are equidistant from the third pin receiving aperture.

6. The wall of claim 1 wherein the lower surface of the block comprises a channel that is parallel to and equidistant from the first and second faces.

7. The wall of claim 1 wherein the block comprises a core extending the thickness of the block.

* * * * *